US005984626A

United States Patent [19]

Kotkaniemi

[11] Patent Number: 5,984,626

[45] Date of Patent: Nov. 16, 1999

[54] EVACUATION MEANS FOR PUMPS

[75] Inventor: Leo Kotkaniemi, Nol, Sweden

[73] Assignee: ABS Pump Production AB, Molndal, Sweden

[21] Appl. No.: 09/042,727

[22] Filed: Mar. 17, 1998

[30] Foreign Application Priority Data

Mar. 26, 1997 [SE] Sweden ..... 97011530

[51] Int. Cl.[6] ..... F01B 25/00

[52] U.S. Cl. ..... 415/24; 415/26; 415/27; 415/47; 415/49; 415/56.1; 415/169.1; 417/199.2; 417/200

[58] Field of Search ..... 415/24, 26, 27, 415/47, 49, 56.1, 169.1; 417/199.2, 200

[56] References Cited

U.S. PATENT DOCUMENTS 3,630,637 12/1971 Repp ..... 417/7
3,741,675 6/1973 Porter et al. ..... 415/11
4,183,721 1/1980 Peterson ..... 417/40
4,515,180 5/1985 Napolitano ..... 137/565
5,035,583 7/1991 Vaught ..... 417/200
5,536,147 7/1996 Lang ..... 417/199.2
5,620,309 4/1997 Todden et al. ..... 417/199.2

*Primary Examiner*—Christopher Verdier
*Assistant Examiner*—Matthew T. Shanley
*Attorney, Agent, or Firm*—Pillsbury, Madison & Sutro, LLP

[57] ABSTRACT

The present invention is for an evacuation system which preferrably in its entirety is connected to and operates at the outlet side of a pump. The evacuation system is connected to the socket 5 by the connector 9 and one of the valves 15 or 16. In the evacuation system there is a compressor 19 and a pressurized air ejector 18. Air from the ejector exits through a pipe 24.

6 Claims, 1 Drawing Sheet

EVACUATION MEANS FOR PUMPS

FIELD OF THE INVENTION

The present invention is for an evacuation means, primarily intended to be used for waste water pumps, and for pumps having such means.

BACKGROUND OF THE INVENTION

For the pumping of waste water centrifugal pumps are generally used, which can be started only if there is liquid in the pump body. The present invention is for an evacuation system to ensure that there is liquid in the pump body during start up and operation.

The supply of waste water to the pump is often irregular and occasionally nil. If nothing is done, the liquid level of the system will then fall so that air penetrates the pump body at a small or large extent. Also during operation air may occur in the pump body due to a too small supply of liquid or for other reasons. The pumping may then be interrupted, in spite of that, there is a small inflow of waste water. The waste water may also contain various kinds of contaminations, which cause difficulties and plugging, especially in connection with interruptions of the process.

In order to restart pumps which have been emptied of liquid it is known in the art to make use of evacuation systems, which create a vacuum at the low side of the pumps, so that liquid is lifted to the pumps. Such an evacuation system includes a closed container with a level sensor, i. e. a floater, and is mounted to the inlet tube of the pump. At the outlet side there is mounted a valve which is controlled by signals from the floater. After an interruption a vacuum pump evacuates the air from the pump through the container until it is filled with so much liquid that the floater raises and gives a starting signal to the pump. The system also controls and opens the outlet valve. If the level in the container of the floater falls, the vacuum unit will start again and evacuate the air until there is another signal from the floater.

SUMMARY OF THE INVENTION

The present invention is for an evacuation system which preferrably as an entirety is connected to and operating at the outlet end of the pump.

The invention will below be described more in detail with reference to the embodiment which is shown in the enclosed drawings.

DETAILED DESCRIPTION OF THE PREFERRED EMBODIMENT

Figure 1:
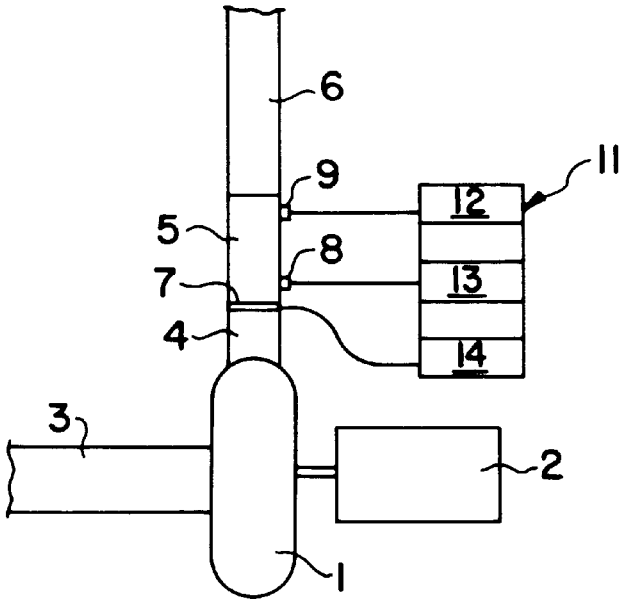
FIG. 1 shows a pump and the evacuation system for the pump.

The device as shown in FIG. 1 comprises a centrifugal pump 1, which is driven by a motor 2. Waste water is supplied to the pump through an inlet tube 3 and delivered through an outlet 4. From the outlet the pumped waste water is taken through a socket 5 to a tube 6. Adjacent the socket 5 there is a level guard 7 and at the socket there are connections 8, 9 for the pressure guard and evacution. The level guard, pressure guard and evacuation pipe are connected to a control and evacuation system 11, which comprises units for monitoring of level 14 and pressure 13 and for evacuation 12.

Figure 2:
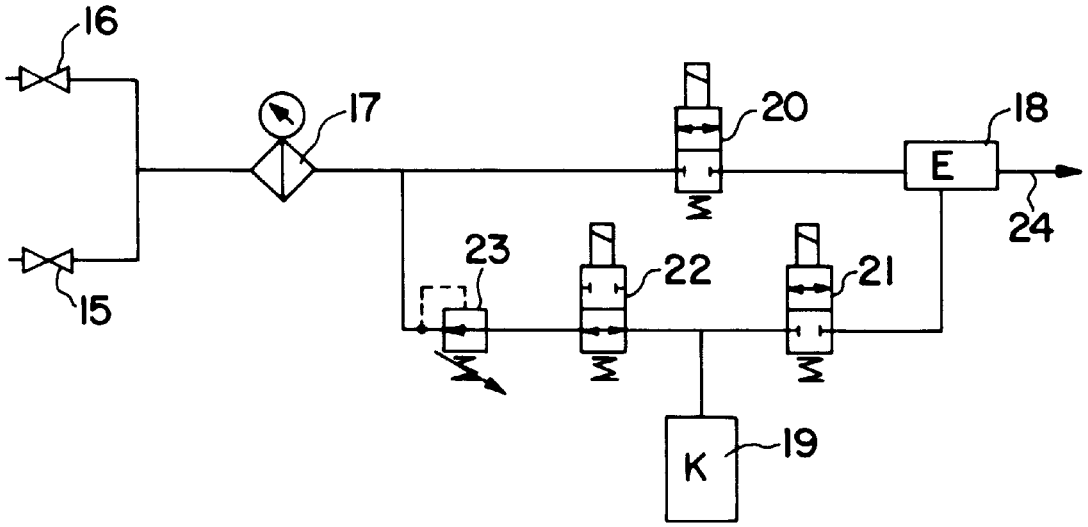
FIG. 2 schematically shows the evacuation system more in detail.

The components of the evacuation system are shown more in detail in FIG. 2. The evacution system is connected to the socket 5 by the connection 9 and at least one of the valves 15 or 16. In the evacuation system there is a compressor 19 and a pneumatic ejector 18. Air from the ejector exits from the system through a pipe 24.

At the start of the pump 1 the evacuation shall start if there is absence of liquid at the level guard 7. The solenoid valves 20 and 21 are then opened up while the valve 22 is kept closed. Air then flows from the compressor, which supplies a pressure of about 6 bars, and drives the ejector so that the pump body, the inlet tube 3 and the outlet tube 4 up to the level guard 7 are evacuated and filled with liquid which is sucked in due to the underpressure which is generated. When the pump then starts at a signal from the system the solenoid valves 20 and 21 are closed and the valve 22 is opened. A pressure regulator 23 connected to the socket 5 by connection 8 is arranged so that the pressure in the system out to the valves 15, 16 is at about 2 bars. In the connecting pipe between the valves 15, 16 and the evacuation system there is a filter 17, by which a manometer may be connected for monitoring so that cleaning of the filter can be made at suitable occasions.

If during operation air enters the pump and its connecting tubes in such quantities that the function of the pump is disturbed then the level guard 7 will initiate a restart of the evacuation system. Then one of the valves 15, 16 is opened and due to the overpressure in the system the opened valve is blown clean out to the outlet tube 6 of the pump. Thereupon the valve 22 is closed and the valves 20 and 21 are opened and evacuation of the system takes place as described above.

In another embodiment of the invention evacuation may be by other means, for example a vacuum pump, liquid ring pump or liquid fluid ejector to create the necessary vacuum. The system then works with liquid instead of air and at the start of the evacuation there is a washing instead of a blowing of the valves 15 or 16.

The pressure at the valve 15 or 16 which connects to the pump tube ought to be lower then the operating pressure of the evacuation means but higher than the operating pressure at the pressure side of the pump during normal conditions of operation, so that any leakage is isolated to the pump system.

In special cases the evacuation system of the invention may also be connected to the suction side of the pump.

Within the frame of the inventive idea various embodiments are possible where for example the components of the system may be exchanged. It is, however, essential for the inventive idea that there is always a small overpressure at the evacuation system side of the valves 15 and 16 which are connected to the pump tube, so that there is an automatic blowing of the valves initially in each cycle of operation of the evacuation system. This pressure shall be slightly higher than the pressure in the tubes of the pump so that a possible leakage in any of the valves 15, 16 does not mean that liquid enters the evacuation system.

I claim:

1. An evacuation system for evacuating a pump, comprising:

a valve for mounting to the pump; and a control system connected to the valve for controlling opening and closing of the valve;

wherein when the valve is closed said control system maintains an overpressure at a side of the valve connected to the evacuation system, and wherein when the valve is opened blowing or flushing of the valve occurs.

2. An evacuation system for evacuating a pump according to claim 1, further including a vacuum device connected to the valve for evacuating the pump.

3. An evacuation system for evacuating a pump according to claim 1, wherein at normal operating conditions the overpressure at said side of the valve connected to the evacuation system is greater than a pressure at the pressure side of the pump.

4. An evacuation system for evacuating a pump, which has a pressure side and a suction side, according to any one of claims 1–3, further including said pump and a conection connecting said evacuation system to one of said pressure side and said suction side of the pump.

5. An evacuation system for evacuating a pump according to any one of claims 1–3, wherein the evacuation system further comprises a level guard which detects an absence of pumped liquid and generates a signal to the evacuation system to begin evacuation of the pump.

6. An evacuation system for evacuating a pump, which has a pressure side and a suction side, according to any one of claims 1–3, further including said pump and a connection connecting said evacuation system to one of said pressure side and said suction side of the pump, and wherein the evacuation system further comprises a level guard which detects an absence of pumped liquid and generates a signal to the evacuation system to begin evacuation of the pump.

* * * * *